US005755610A

United States Patent [19]

Lin

[11] Patent Number: 5,755,610

[45] Date of Patent: May 26, 1998

[54] CLIMBING TOY MACHINE

[76] Inventor: Kuo Jung Lin, No. 100, Lane 175, Cheng Kung Road, Tainan, Taiwan

[21] Appl. No.: 821,296

[22] Filed: Mar. 20, 1997

[51] Int. Cl.[6] ..... A63H 11/04; A63H 31/00

[52] U.S. Cl. ..... 446/315; 446/330; 446/490; 40/415

[58] Field of Search ..... 446/314, 315, 446/330, 331, 353, 361, 490; 40/415

[56] References Cited

U.S. PATENT DOCUMENTS 5,320,572 6/1994 Chen ..... 446/315

*Primary Examiner*—Robert A. Hafer
*Assistant Examiner*—Laura Fossum
*Attorney, Agent, or Firm*—Bacon & Thomas

[57] ABSTRACT

A climbing toy machine has a motor, a drive pinion set, a climbing gear set, a first rack plate, a second rack plate, and a retard gear. The drive pinion set and the climbing gear set are disposed between the first rack plate and the second rack plate. The drive pinion set engages with the climbing gear set. A disk is disposed under the first and the second rack plates. A seat is disposed on the disk. A first and a second U-shaped plates are disposed on the seat to receive the first rack plate. A third and a fourth U-shaped plates are disposed on the seat to receive the second rack plate. A movable plate is disposed between the first and the second rack plates. A press plate is connected to the movable plate. A protruded bar is disposed on the movable plate. A separator is disposed between the movable plate and the second rack plate. A spool is disposed between the separator and the second rack plate.

1 Claim, 4 Drawing Sheets

CLIMBING TOY MACHINE

BACKGROUND OF THE INVENTION

The invention relates to a climbing toy machine. More particularly, the invention relates to a climbing toy machine which has a simple structure.

A conventional climbing toy machine has a complex structure. The conventional climbing toy machine needs a plurality of gear sets such as at least a retard gear set, at least a planetary gear set, and at least a climbing gear set. The motions of the conventional climbing toy machine contain the rotational motion and the linear motion However, the stress produced by the conversion of the rotational motion and the linear motion may damage the motor easily. Therefore, the load of the motor is increased and the period of usage of the motor is shortened.

SUMMARY OF THE INVENTION

An object of the invention is to provide a climbing toy machine which has a simple structure so that the load of the motor will not be increased.

Accordingly, a climbing toy machine comprises a motor, a drive pinion set, a climbing gear set, a first rack plate, a second rack plate, and a retard gear. A disk is disposed under the first and the second rack plates. A seat is disposed on the disk. A first U-shaped plate is disposed on the seat. A second U-shaped plate is disposed on the seat. A third U-shaped plate is disposed on the seat. A fourth U-shaped plate is disposed on the seat. A first block plate is disposed on a first lateral of the seat. A second block plate is disposed on a second lateral of the seat. A first fixed bar passes through the first rack plate, the first U-shaped plate, the third U-shaped plate, and the second rack plate to position the first rack plate and the second rack plate on the seat. A second fixed bar passes through the first rack plate, the second U-shaped plate, the fourth U-shaped plate, and the second rack plate to position the first rack plate and the second rack plate on the seat. A movable plate is disposed between the first and the second rack plates. A press plate is connected to the movable plate. A protruded bar is disposed on the movable plate. A separator is disposed between the movable plate and the second rack plate. A spool is disposed between the separator and the second rack plate. An oblong hole is formed on the first rack plate. A first slot is formed on the movable plate. A second slot is formed on the movable plate. A third slot is formed on the separator. The motor is disposed between the first and the second rack plates. The drive pinion set has a first pinion, a retard gear, a second pinion, a third pinion, and a fourth pinion. The retard gear is disposed on the first rack plate. The first pinion is connected to the motor. The first pinion engages with the retard gear. The retard gear are disposed on the second pinion coaxially. The second pinion engages with the third pinion. An axle of the fourth pinion passes through the oblong hole, the movable plate and the third slot. The climbing gear set has a first variable speed gear, a second variable speed gear, a third variable speed gear, a fourth variable speed gear, and a drive gears. The first variable speed gear and the second variable speed gear are coaxial. The third variable speed gear and the fourth variable speed gear are coaxial. The second variable speed gear engages with the third variable speed gear. The fourth variable speed gear engages with the drive gear. A calliper plate is connected to the drive gear. An auxiliary plate extends laterally from the calliper plate. An elongated rod is disposed on the calliper plate. A shaft passes through the first rack plate, the drive gear, the calliper plate, and the spool. A spring is connected to the first and the second block plates. A rope winds the spool.

DETAILED DESCRIPTION OF THE INVENTION

Figure 1:
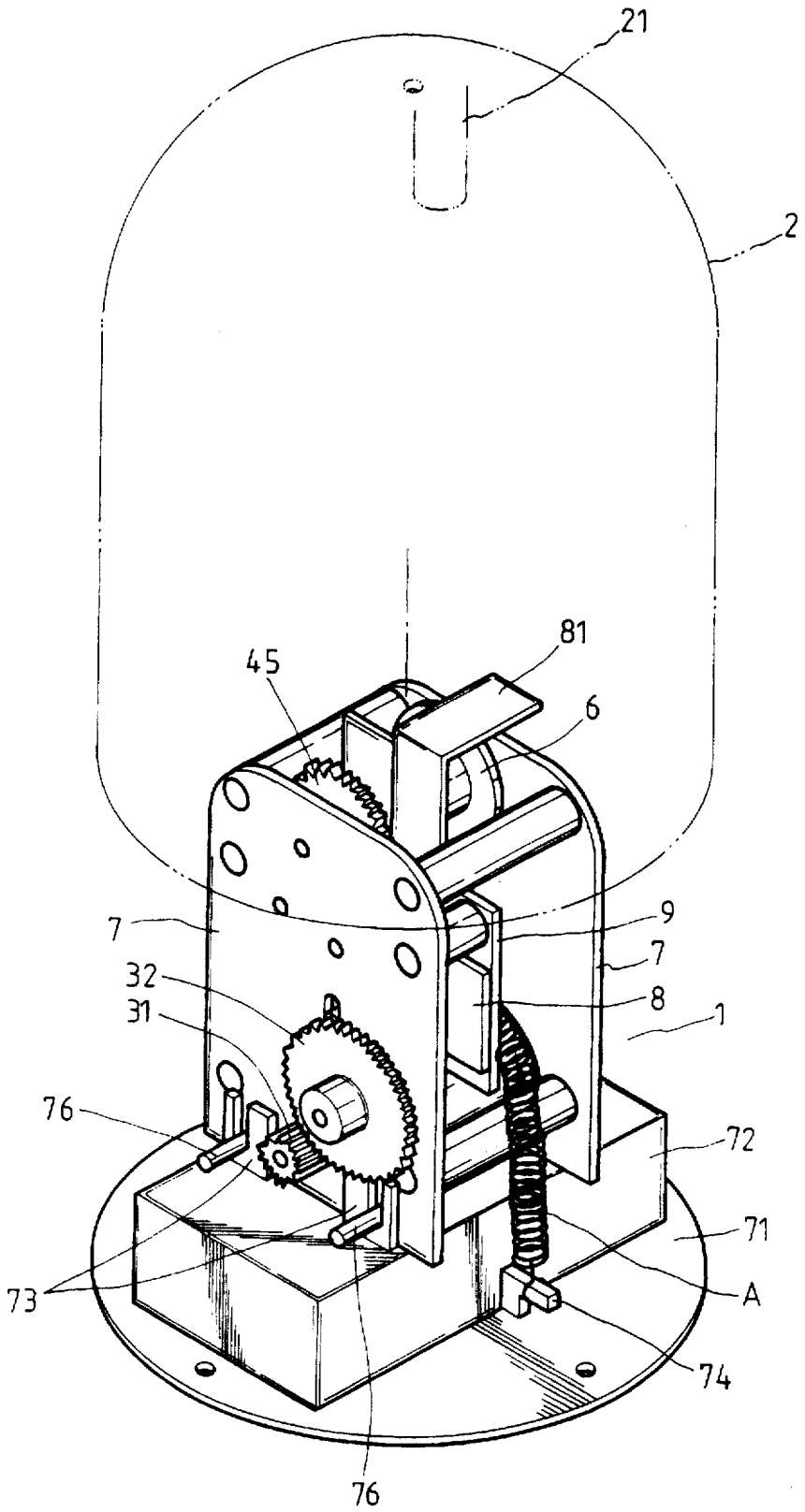
FIG. 1 is a perspective assembly view of a climbing toy machine of a preferred embodiment in accordance with the invention.
Figure 2:
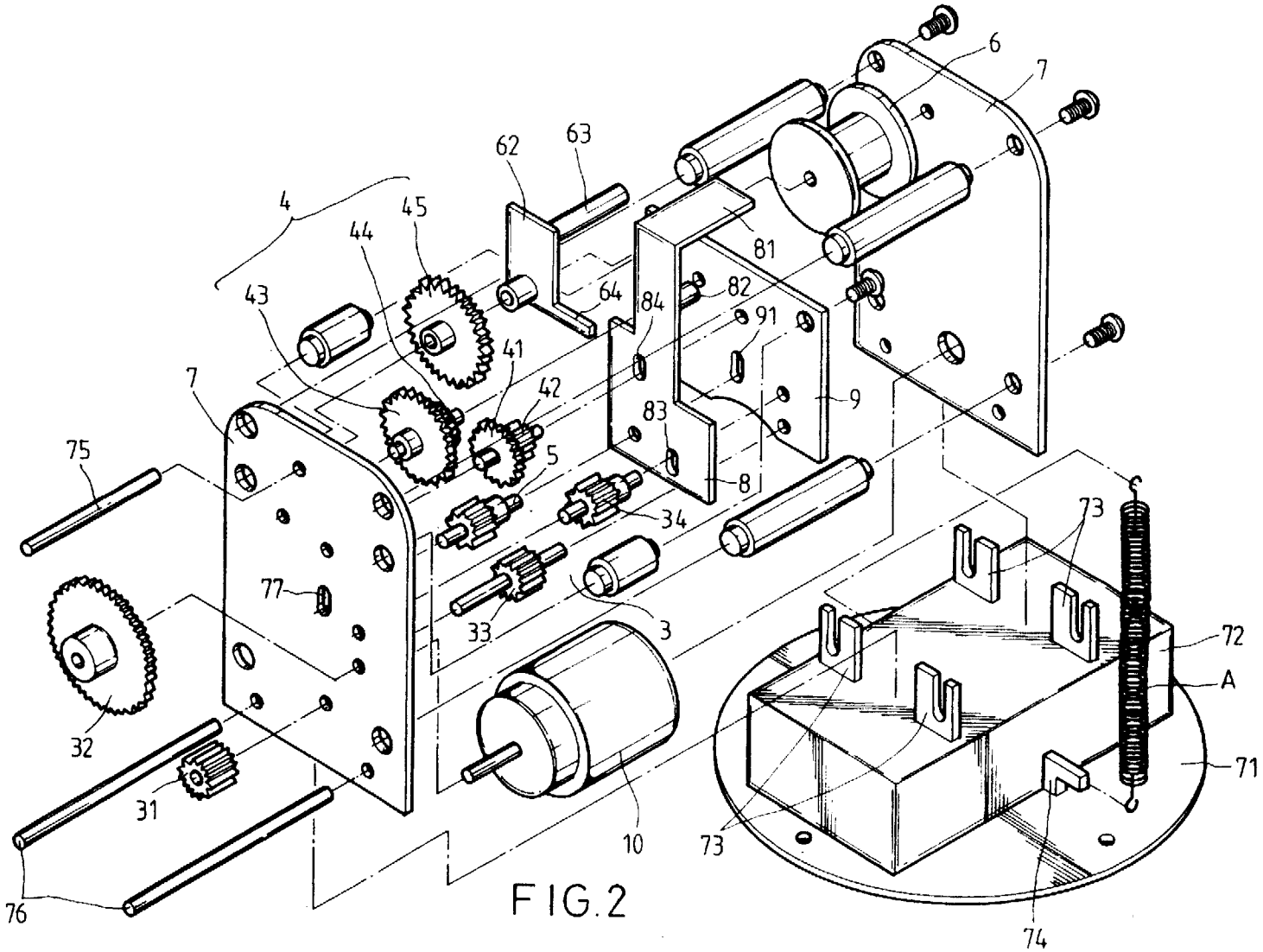
FIG. 2 is a perspective exploded view of a climbing toy machine of a preferred embodiment in accordance with the invention.

Referring to FIGS. 1 and 2, a climbing toy machine 1 comprises a motor 10, a drive pinion set 3, a climbing gear set 4, a first rack plate 7, a second rack plate 7, and a retard gear 32 A disk 71 is disposed under the first and the second rack plates 7. A seat 72 is disposed on the disk 71. A first U-shaped plate 73 is disposed on the seat 72. A second U-shaped plate 73 is disposed on the seat 72. A third U-shaped plate 73 is disposed on the seat 72. A fourth U-shaped plate 73 is disposed on the seat 72 A first block plate 74 is disposed on a first lateral of the seat 72. A second block plate 74 is disposed on a second lateral of the seat 72. A first fixed bar 76 passes through the first rack plate 7, the first U-shaped plate 73, the third U-shaped plate 73, and the second rack plate 7 to position the first rack plate 7 and the second rack plate 7 on the seat 72. A second fixed bar 76 passes through the first rack plate 7, the second U-shaped plate 73, the fourth U-shaped plate 73, and the second rack plate 7 to position the first rack plate 7 and the second rack plate 7 on the seat 72. A movable plate 8 is disposed between the first and the second rack plates 7 A press plate 81 is connected to the movable plate 8. A protruded bar 82 is disposed on the movable plate 8. A separator 9 is disposed between the movable plate 8 and the second rack plate 7. A spool 6 is disposed between the separator 9 and the second rack plate 7. An oblong hole 77 is formed on the first rack plate 7. A first slot 83 is formed on the movable plate 8. A second slot 83 is formed on the movable plate 8 A third slot 91 is formed on the separator 9 The motor 10 is disposed between the first and the second rack plates 7. The drive pinion set 3 has a first pinion 31, a retard gear 32, a second pinion 33, a third pinion 34, and a fourth pinion 5. The retard gear 32 is disposed on the first rack plate 7. The first pinion 31 is connected to the motor 10. The first pinion 31 engages with the retard gear 32. The retard gear 32 are disposed on the second pinion 33 coaxially. The second pinion 33 engages with the third pinion 34. An axle of the fourth pinion 5 passes through the oblong hole 77, the movable plate 8 and the third slot 91. The climbing gear set 4 has a first variable speed gear 41, a second variable speed gear 42, a third variable speed gear 43, a fourth variable speed gear 44, and a drive gear 45. The first variable speed gear 41 and the second variable speed gear 42 are coaxial. The third variable speed gear 43 and the fourth variable speed gear 44 are coaxial. The second variable speed gear 42 engages with the third variable speed gear 43. The fourth variable speed gear engages with the drive gear 45. A calliper plate 62 is connected to the drive gear 45. An auxiliary plate 64 extends laterally from the calliper plate 62. An elongated rod 63 is disposed on the calliper plate 62. A shaft 75 passes through the first rack plate 7, the drive gear 45, the calliper plate 62, and the spool 6. A spring A is connected to the first and the second block plates 74.

Referring to FIGS. 3 to 6, a rope 61 winds the spool 6. A casing 2 covers the climbing toy machine 1. A protruded rod 21 is disposed in a top portion of the casing 2. A fixed ring B is disposed on the casing 2. One end of the rope 61 is connected to the fixed ring B.

Figure 4:
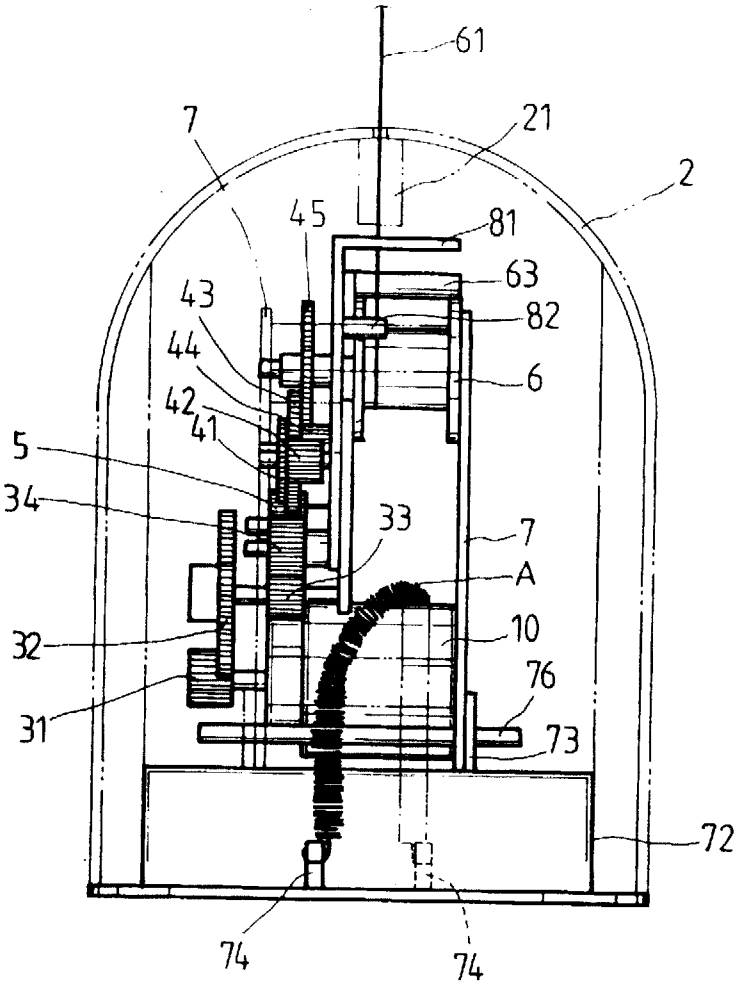
FIG. 4 is another schematic view illustrating an operation of a climbing toy machine of a preferred embodiment while the climbing toy machine is ascended.
Figure 3:
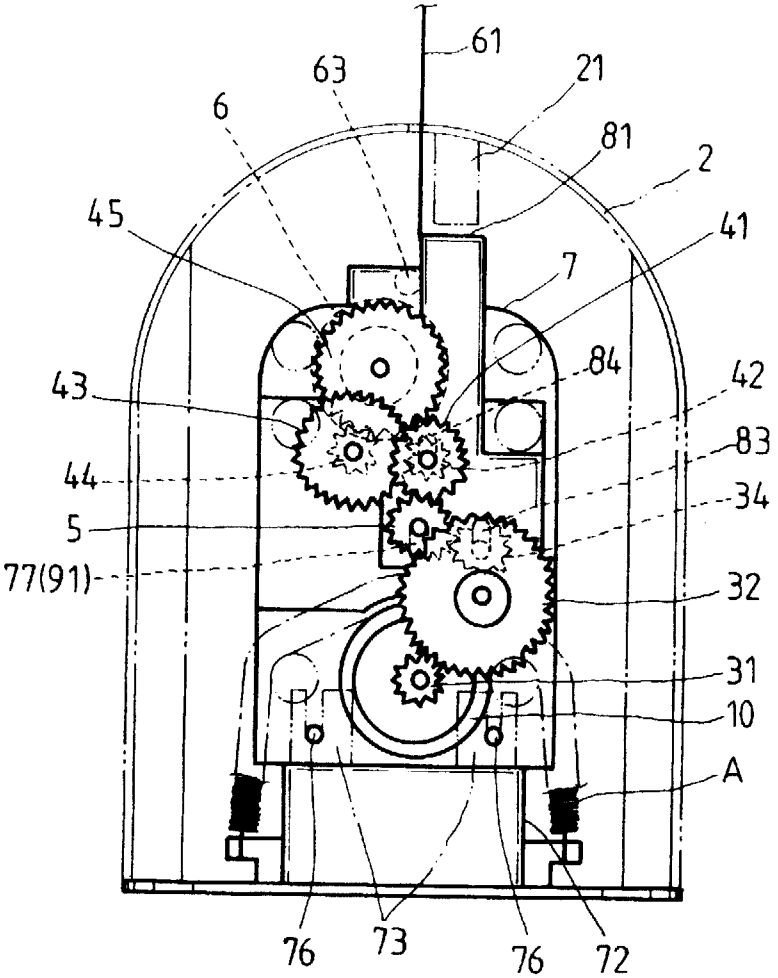
FIG. 3 is a schematic view illustrating an operation of a climbing toy machine of a preferred embodiment while the climbing toy machine is ascended.

Referring to FIGS. 3 and 4, the third pinion 34 engages with the fourth pinion 5. The fourth pinion 5 engages with the first variable speed gear 41. Thus the spool 6 will rotate until the climbing toy machine 1 ascends upward.

Figure 6:
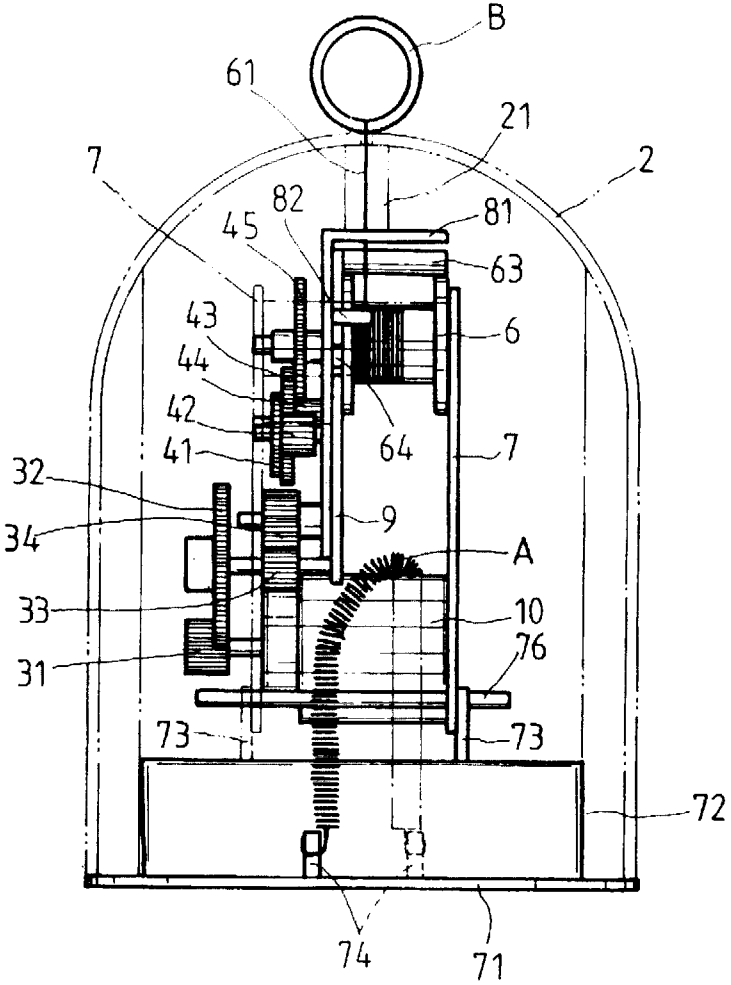
FIG. 6 is another schematic view illustrating an operation of a climbing toy machine of a preferred embodiment while the climbing toy machine is descended.
Figure 5:
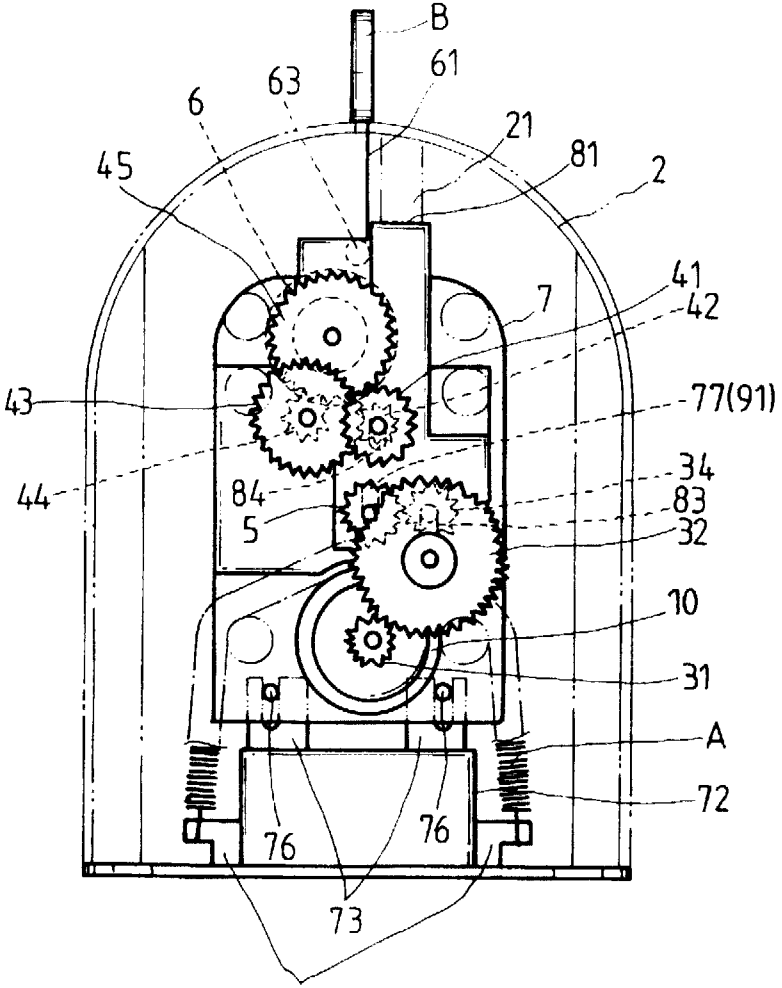
FIG. 5 is a schematic view illustrating an operation of a climbing toy machine of a preferred embodiment while the climbing toy machine is descended.

Referring to FIGS. 5 and 6, the protruded rod 21 presses the press plate 81 downward. The movable plate 8 moves downward so that the fourth pinion 5 moves downward with the movable plate 8. Thus the fourth pinion 5 disengages from the first variable speed gear 41. The climbing toy machine 1 will descend downward because of the gravity.

The invention is not limited to the above embodiment but various modification thereof may be made. Further, various changes in form and detail may be made without departing from the scope of the invention.

I claim:

1. A climbing toy machine comprising:

a motor, a drive pinion set, a climbing gear set, a first rack plate, a second rack plate, and a retard gear, a disk disposed under the first and the second rack plates, a seat disposed on the disk, a first U-shaped plate disposed on the seat, a second U-shaped plate disposed on the seat, a third U-shaped plate disposed on the seat, a fourth U-shaped plate disposed on the seat, a first block plate disposed on a first lateral of the seat, a second block plate disposed on a second lateral of the seat, a first fixed bar passing through the first rack plate, the first U-shaped plate, the third U-shaped plate, and the second rack plate to position the first rack plate and the second rack plate on the seat, a second fixed bar passing through the first rack plate, the second U-shaped,plate, the fourth U-shaped plate, and the second rack plate to position the first rack plate and the second rack plate on the seat, a movable plate disposed between the first and the second rack plates, a press plate connected to the movable plate, a protruded bar disposed on the movable plate, a separator disposed between the movable plate and the second rack plate, a spool disposed between the separator and the second rack plate, an oblong hole formed on the first rack plate, a first slot formed on the movable plate, a second slot formed on the movable plate, a third slot formed on the separator, the motor disposed between the first and the second rack plates, the drive pinion set having a first pinion, a retard gear, a second pinion, a third pinion, and a fourth pinion, the retard gear disposed on the first rack plate, the first pinion connected to the motor, the first pinion engaging with the retard gear, the retard gear disposed on the second pinion coaxially, the second pinion engaging with the third pinion, an axle of the fourth pinion passing through the oblong hole, the movable plate and the third slot, the climbing gear set having a first variable speed gear, a second variable speed gear, a third variable speed gear, a fourth variable speed gear, and a drive gear, the first variable speed gear and the second variable speed gear being coaxial, the third variable speed gear and the fourth variable speed gear being coaxial, the second variable speed gear engaging with the third variable speed gear, the fourth variable speed gear engaging with the drive gear, a calliper plate connected to the drive gear, an auxiliary plate extending laterally from the calliper plate, an elongated rod disposed on the calliper plate, a shaft passing through the first rack plate, the drive gear, the calliper plate, and the spool, a spring connected to the first and the second block plates, and a rope winding the spool.

* * * * *